United States Patent [19]

Siebke

[11] Patent Number: 4,579,289

[45] Date of Patent: Apr. 1, 1986

[54] SKEW ROLLER FOR A PLANETARY TYPE SKEW ROLLING MILL

[75] Inventor: Tycho Siebke, Eschweiler, Fed. Rep. of Germany

[73] Assignee: Eschweiler Bergwerks-Verein Aktiengesellschaft, Herzogenrath, Fed. Rep. of Germany

[21] Appl. No.: 549,451

[22] Filed: Nov. 7, 1983

[51] Int. Cl.[4] ..... B02C 15/00

[52] U.S. Cl. ..... 241/110; 241/123; 241/294; 29/122; 72/78

[58] Field of Search ..... 241/110, 117, 118, 123, 241/124, 293, 294, 295; 29/122, 125; 72/78, 96, 97

[56] References Cited

U.S. PATENT DOCUMENTS 1,999,987 4/1935 Diescher ..... 29/116

3,029,764 4/1962 Sporck ..... 29/125 X

*Primary Examiner*—Howard N. Goldberg

*Assistant Examiner*—Timothy V. Eley

*Attorney, Agent, or Firm*—W. G. Fasse; D. H. Kane, Jr.

[57] ABSTRACT

A skew rolling mill is equipped with a plurality of skew or inclined rollers each of which is constructed of a number of roller segments (1', 2) which are interconnected in a form-locking, force transmitting manner. These roller segments are so related to one another that different roller segments may be assembled to form a plurality of different skew rollers which differ from one another with regard to their calibration and purpose. Thus, different roller segments may have different structural features and they may be made of different materials. Such variability obviates the need for keeping complete sets of skew rollers in stock for each size or calibration.

6 Claims, 1 Drawing Figure

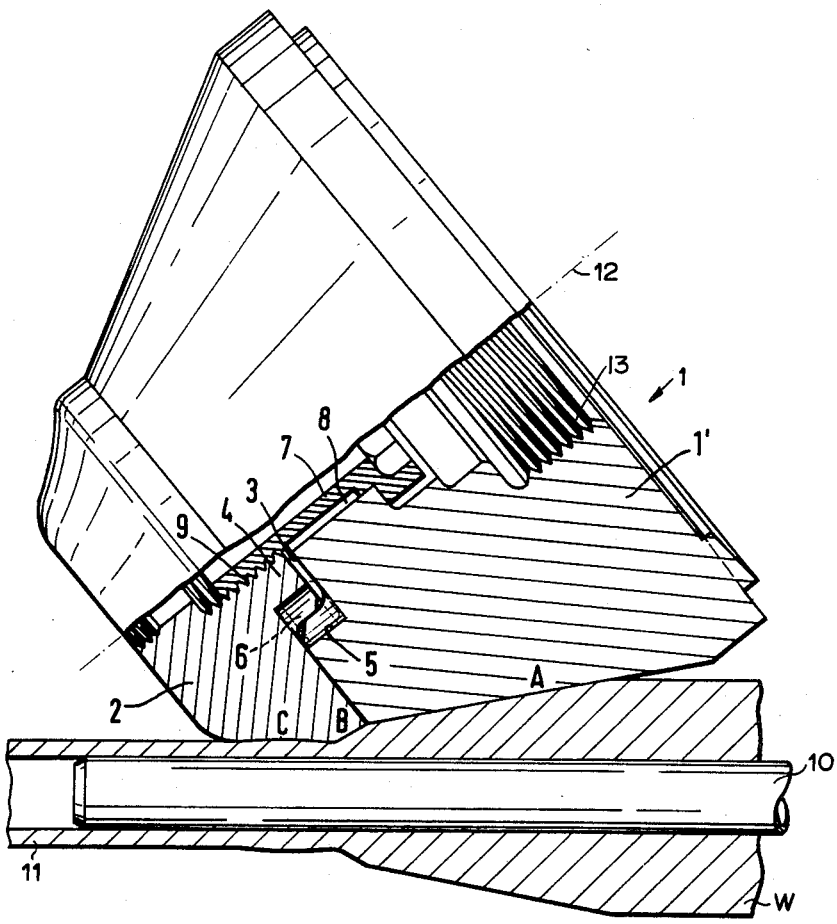
12
13
1
1'
8
7
3
4
9
6
5
A
2
C
B
10
11
W

SKEW ROLLER FOR A PLANETARY TYPE SKEW ROLLING MILL

FIELD OF THE INVENTION

The invention relates to planetary type skew rolling mills in general, and to skew rollers for such mills in particular. Such mills are used for reducing the dimension, especially the cross-sectional dimension, of blocks, billets, or rods, for example, to manufacture tubular stock from thick-walled hollow blocks.

BACKGROUND OF THE INVENTION

Planetary type skew rolling mills are known in the art for reducing billets having solid cross-sections. Such mills have a hollow axis which permits the passing through of the material being milled. A roller carrier which is driven is mounted on the hollow axis. The roller carrier comprises three driven conical or skew rollers having a central rotational axis which is inclined relative to the hollow axis. These skew rollers are distributed around the hollow axis at 120° spacings. These skew rollers are so inclined relative to the hollow axis that extensions of the roller axes intersect each other at equal short spacings between the intersection and the next adjacent end of the respective skew roller. Each of the skew rollers is arranged for cooperation with an adjustment device or screw down gear for the axial displacement of the skew roller shaft. Planetary gear wheels which revolve around the milling axis cooperate or mesh with a sun gear wheel.

In order to use such planetary skew rolling mills for rolling material having a full, solid cross-section as well as hollow blocks with thick walls for producing pipe stock, it is necessary to use skew rollers having special calibrations or a profiling or fairing which varies over the width of the skew roller, such width extending in the axial direction of the respective skew roller. During the operation of these skew rollers differing frictional coefficients occur over the width of the skew rollers. For example, at the intake zone of the rollers a certain traction is required, whereas in the transition area between the size reducing zone and the smoothing zone the skew roller surface shall be as smooth as possible. The smoothing surface of the skew roller itself shall also be as smooth as possible. Additionally, different types of skew rollers having different dimensions and surface configurations are required for different types of materials as well as for hollow blocks of the same material, but having different dimensions. Similarly, different types of skew rollers are required for manufacturing final products having different final cross-sections or dimensions.

As a result, it would be necessary to keep in stock a substantial number of different skew rollers having different dimensions and shapes. It seems that this large number was the reason for the fact that planetary type skew rolling mills have not been used heretofore for milling starting materials having a solid cross-sectional shape to manufacture stock having a predetermined final cross-section. Such planetary type skew rolling mills have also not been used for milling down hollow blocks to the size of tubular stock.

OBJECTS OF THE INVENTION

In view of the above it is the aim of the invention to achieve the following objects singly or in combination:

- to provide a planetary type skew rolling mill which is equally suitable for milling down massive blocks or billets to make solid cross-sectional stock as well as for milling down hollow blocks to manufacture tubular stock;
- to enable the retooling of a planetary type skew rolling mill for making solid and tubular stock of different dimensions;
- to avoid the need for keeping in stock a large number of differently constructed skew rollers for such a mill; and
- to enable the formation of skew rollers of a given type by using skew roller segments from different types of skew rollers so that the number of possible mutations is greatly increased.

SUMMARY OF THE INVENTION

The skew rollers according to the invention are constructed of at least two roller segments which are releasably interconnected with each other in a form-locking manner and in a force transmitting manner. By assembling a skew roller by using several skew roller segments it is now possible to provide a substantial number of skew rollers of different types or groups without the need for keeping in stock a correspondingly large number of complete skew rollers. The rollers according to the invention are so constructed that they comprise at least one roller segment which is exchangeable against any roller segment of groups of roller segments. Thus, it becomes possible, for example, to combine an intake type roller segment selectively with any one of a group of transition roller segments or with any one of a group of smoothing roller components, whereby the selection may be made with due regard to the respective requirements in the intake zone, the transition zone, and the smoothing zone of a skew roller. Thus, if requirements vary, it is no longer necessary to replace a one piece skew roller entirely against another one piece skew roller.

The skew roller segments according to the invention may differ in their sizes or calibration as well as in the types of materials of which the skew roller segments are made. Thus, it is possible to assemble complete skew rollers from skew roller segments made of different materials and of different calibrations and/or surface configurations.

BRIEF FIGURE DESCRIPTION

In order that the invention may be clearly understood, it will now be described, by way of example, with reference to the accompanying drawings, wherein the single FIGURE illustrates a skew roller for a skew rolling mill according to the invention partially in section.

DETAILED DESCRIPTION OF A PREFERRED EXAMPLE EMBODIMENT AND OF THE BEST MODE OF THE INVENTION

The FIGURE shows the hollow arbor type axle 10 of the rolling mill supporting a work piece W in the conventional manner to produce, for example, tubular stock 11 by reducing the diameter of the work piece. Only one skew roller 1 rotatable about a rotational axis 12 is shown. However, normally, three such rollers are circumferentially distributed around the arbor 10 at a spacing of 120° between adjacent rollers.

According to the invention each skew roller 1 is constructed of at least two skew roller segments. For example, the roller 1 comprises a first segment 1' having a width in the direction of the rotational axis 12 corresponding substantially to the length of the conical diameter reducing zone A, and a second roller segment 2 having an axial width corresponding substantially to the width of the transition zone B and of the smoothing zone C. The transition zone B forms a shoulder for a further diameter reduction of the work piece W.

The effective surface of the roller segment 1' has a certain roughness, not visible in the drawing, which is determined by the deforming work to be performed by the diameter reducing zone A. On the other hand, the roller segment 2 must be highly resistant against wear and tear in order to assure the proper dimension of the final milled cross-sectional size of the stock 11 over prolonged periods of time. Compared to the relatively rough surface of the roller segment 1', the roller segment 2 has a relatively smooth surface at least in the smoothing zone C.

The first and second roller segment 1', 2 are held together in a form and force-locking manner by form-locking members and force-locking members forming first and second force transmitting means. The first force transmitting means are constituted as form-locking members and comprise a concentric recess 3 in one of the roller segments, for example, the segment 1' and a respectively dimensioned concentric stud 4 provided in the other roller segment, for example, segment 2 for fitting without play into the recess 3 for transmitting forces in a direction radially relative to a central rotational axis of the skew roller.

The second force-transmitting means include second form-locking members and force-locking means. The second form-locking members comprise cylindrical bores 5 which are distributed circumferentially along the periphery of the projection or stud 4 or of the diameter of the recess 3 so that a portion or section of a hole is in the segment 1' while the other portion or section is in the stud 4. The second form-locking members also include cam members or entraining bodies 6 located in these bores 5, whereby a relative displacement between the segments 1' and 2 in the circumferential direction is prevented. The force-locking means include members effective in the axial direction namely a threaded bolt 7 extending through a concentric bore 8 in the direction of the central axis 12 and engaging a shoulder in one segment and a threading 9 in the other segment, for example, in the segment 2. By tightening the threaded bolts 7, the two segments are held tightly together in the axial direction in a force-locking manner. The segment 1' is further provided with an internal threading 13 for connection to a drive shaft not shown. Thus, the force-transmitting connection in the radial direction is accomplished by the engagement of the stud or projection 4 in the recess 3. The force-transmitting connection in the tangential or circumferential direction is accomplished by the entraining bodies 6 in the bores 5, while the axial connection is accomplished by the threaded bolts 7 in the threading 9.

The advantages of the invention are seen in the following features. For example, changes in the calibration of the partial zones A, B, and/or C do not require a lathe operation of the entire roller. Rather, it is now possible to turn but a single zone of any one of the roller segments. Further, differing deformation requirements may now be satisfied by making the differently calibrated zones of the roller of different materials and by constructing the calibration determining shape of the roller portion so that each roller portion or segment of a skew roller will exhibit the optimal calibration and will be made of the optimally effective material. Further, the costs and the machining of the individual roller segments of a skew roller according to the invention are more advantageous as compared to conventional, single piece skew rollers. The same applies to obtaining roller segments because their versatility will contribute to a greater availability.

Further, it is now possible to maintain in stock a relatively small number of roller segments rather than whole sets of single piece rollers for planetary type skew rolling mills. Moreover, tests with changed calibrations and different materials can now be made at a minimum of costs because it is no longer necessary to discard entire rollers as a result of a failed test. Rather, only a roller segment may have to be discarded according to the invention.

Yet another advantage of the invention is seen in that it is now possible to test the skew rollers at a substantially reduced expense because a skew roller may be modified by merely subjecting a roller segment to a turning operation on a lathe rather than the entire roller. Thus, if after a turning operation it is found that the desired effect on the work piece cannot be achieved with the particular shape or surface configuration of the roller segment or with a different material, then only that roller segment requires replacement. Further, by keeping roller segments of two types of rollers in stock it is now possible to assemble several other roller types by exchanging roller segments of different fairing or surface configuration and roller segments of different materials from one group with those of another group. As a result, it is now possible to assemble a substantial number of different skew rollers which number exceeds the number of individual roller segments by a multiple.

One roller segment group may, for example, comprise a recess adapted to receive in a form-locking manner a projection of another group of roller segments.

By dividing the rollers as taught herein, it is now possible to arrange the plane of division in such a way that zones subject to a relatively large wear and tear may now be individually replaced so that it is not necessary to discard the entire skewing roller. Even a restoring turning operation may be localized. The variability of the individual skew rollers, especially with regard to the calibration, or rather calibration steps, has been greatly increased, whereby the selection of an optimal calibration of the individual rollers has been substantially facilitated without any increase in costs. Thus, it is now possible to minimize any subsequent forming operations of the stock as it emerges from the rolling mill by optimizing the calibration of the skew rollers.

By making different skew roller segments of different materials, these materials can now be selected with due regard to the particular wear and tear in the specific zone of a roller segment.

This advantage is especially significant if the deformation along the roller calibration requires different friction coefficients on the roller surface. Such different frictional coefficients are achievable merely by using different materials such as tungsten steel casting combined with spheroidal-graphite cast iron if the wear and tear is to be taken into account.

Further, by assembling these skew rollers as taught herein, the characteristics of the work piece material may also be taken into account which is of particular importance if the material to be deformed calls for a frequent or rather, a plurality of changes in partial zones of the calibration, for example, in the smoothing zone and in the transition from the diameter reducing zone to the smoothing zone.

Although the invention has been described with reference to specific example embodiments it will be appreciated, that it is intended to cover all modifications and equivalents within the scope of the appended claims.

What is claimed is:

1. A positively driven skew roller having a central rotational axis for a planetary type skew rolling mill for manufacturing solid and tubular stock, comprising at least two separable roller segments (1', 2) forming together a single calibration, first force transmitting means including first form-locking members (3, 4) forming part of the shape of said roller segments for interconnecting said at least two roller segments to form a complete single calibration skew roller in a form-locking manner for a force transmission by said first form-locking members through said skew roller in a radial direction relative to said central rotational axis, and second force transmitting means (5, 6, 7, 8, 9) for operatively interconnecting said at least two roller segments in a force transmitting manner, whereby a displacement of one segment relative to the other segment in a circumferential and axial direction is prevented, and wherein each of said at least two roller segments (1', 2) has a different partial calibration, said partial calibrations forming together said single calibration.

2. The skew roller of claim 1, wherein at least one of said roller segments of a given type of skew roller is exchangeable against a different roller segment of another type of skew roller for assembling a third type of skew roller.

3. The skew roller of claim 1, wherein said at least two roller segments are made of two different materials.

4. The skew roller of claim 1, wherein one of said roller segments (2) comprises a projection member (4) arranged concentrically relative to said central axis, the other (2) of said roller segments comprising a wall defining a recess (3) sized to receive said projection member (4) in a form-locking manner, whereby said projection member and said recess constitute said first form-locking members for taking up forces in a radial direction relative to said central rotational axis.

5. The skew roller of claim 4, wherein said second force transmitting means comprise second form-locking members including a plurality of bore sections forming pairs of bore sections (5) distributed on a circle, one bore section of a pair being located on said projection member (4) while the other bore section of said pair is located in said wall defining said recess so that two bore sections provide a full bore, said second form-locking members further comprising a cam member received in each full bore for preventing a relative rotational movement between said two roller segments.

6. The skew roller of claim 1, wherein said second force transmitting means comprise a central bore through both roller segments, a threading (9) in said central bore in one of said roller segments, a shoulder in the other of said roller segments, and a central threaded bolt (7) operatively engaging said threading in said central bore and bearing against said shoulder for securing said roller segments to each other in a force transmitting manner in the axial direction.

* * * * *